United States Patent [19]

Speas

[11] Patent Number: 4,823,928

[45] Date of Patent: Apr. 25, 1989

[54] ELECTRONIC PARKING METER SYSTEM

[75] Inventor: Gary W. Speas, Little Rock, Ak.

[73] Assignee: POM Incorporated, Russellville, Ark.

[21] Appl. No.: 37,252

[22] Filed: Apr. 16, 1987

[51] Int. Cl.[4] ..... G07F 17/24

[52] U.S. Cl. ..... 194/217; 194/317; 368/7

[58] Field of Search ..... 194/217, 218, 317, 900; 368/7, 90, 92; 340/51; 364/569

[56] References Cited

U.S. PATENT DOCUMENTS

| | | | |
|---|---|---|---|
| 2,656,908 | 10/1953 | Ellison . | |
| 2,807,016 | 9/1957 | Gloess . | |
| 3,166,732 | 1/1965 | Ljungman et al. . | |
| 3,373,856 | 3/1968 | Kusters et al. . | |
| 3,482,110 | 12/1969 | Robinson . | |
| 3,535,870 | 10/1970 | Mitchell . | |
| 3,541,308 | 11/1970 | Ruby . | |
| 3,575,586 | 4/1971 | Kroll . | |
| 3,760,160 | 9/1973 | Gieringer et al. . | |
| 3,909,826 | 9/1975 | Schildmeier et al. . | |
| 3,948,373 | 4/1976 | Selby, Jr. . | |
| 3,999,372 | 12/1976 | Welch et al. | 58/142 |
| 4,031,991 | 6/1977 | Malott . | |
| 4,034,193 | 7/1977 | Jackson . | |
| 4,080,598 | 3/1978 | Cardone . | |
| 4,228,519 | 10/1980 | Pfeifer . | |
| 4,249,648 | 2/1981 | Meyer | 194/215 X |
| 4,275,272 | 5/1981 | Mennino, Jr. et al. . | |
| 4,310,890 | 1/1982 | Trehn et al. . | |
| 4,356,903 | 11/1982 | Lemelson et al. | 194/217 |
| 4,379,334 | 4/1983 | Feagins, Jr. et al. | 364/467 |
| 4,460,080 | 7/1984 | Howard | 194/317 |
| 4,483,431 | 11/1984 | Pratt | 194/317 |
| 4,576,273 | 3/1986 | Milnes | 368/90 X |

FOREIGN PATENT DOCUMENTS

| | | | |
|---|---|---|---|
| 2077475 | 12/1981 | United Kingdom | 368/90 |

*Primary Examiner*—F. J. Bartuska

*Attorney, Agent, or Firm*—Hill, Van Santen, Steadman & Simpson

[57] ABSTRACT

An electronic parking meter system for receiving at least one type of coin or other payment device and having an electronic parking meter and an auditor. The electronic parking meter comprises a power source which may be a solar type power source, as well as, having terminals for connection to an external source of power. The meter also has a microprocessor with a memory connected to the power supply. An electronic display is connected to the microprocessor and displays pertinent information for the meter. The auditor may be connected to the microprocessor in the electronic meter by means of a direct cable link or by infrared transmission. The electronic parking meter system may have a sonar range finder connected to the microprocessor in the meter which detects the presence or absence of a vehicle in an associated parking space with the parking meter.

55 Claims, 17 Drawing Sheets

ELECTRONIC PARKING METER SYSTEM

BACKGROUND OF THE INVENTION

This invention relates in general to electronic timing devices and, in particular, to electronic parking meters.

Both mechanical and electronic parking meters are well known in the prior art and are typically of the type which are responsive to the insertion of a coin to begin timing an interval for which a vehicle may be parked in an appropriate space associated with the parking meter. The timing interval is typically determined by the number and value of coins which are inserted into the parking meter. The parking meters can be associated with a single parking space or a single parking meter may be used for an entire lot of multiple spaces.

The more recently developed electronic parking meters are an improvement over the older type mechanical parking meters. The electronic parking meters are typically more reliable and require less service. However, many of these electronic type parking meters still employ portions of them which are mechanical.

It is a feature of the present invention to provide an all electronic parking meter which is more dependable, has a greater varieties of features, and is more economical to manufacture than prior art parking meters. It is an advantage of the present invention that the novel electronic parking meter can be utilized with a hand-held auditor for programming parking meters and also gathering data from the parking meter and which can be connected to the parking meter directly by means of a cable or can be interfaced to the parking meter through an infrared transmission system. It is another feature of the present invention that a sonar range finder may be utilized as a part of the electronic parking meter for detecting the presence or absence of a vehicle in a space associated with the meter.

SUMMARY OF THE INVENTION

The present invention involves an electronic parking meter system for receiving at least one type of coin or other payment device and comprises an electronic parking meter and an auditor. The electronic parking meter comprises a power source which may be a solar type power source, as well as, having terminals for connection to an external source of power. The meter also has a microprocessor with a memory connected to the power supply. The microprocessor has a power-up mode, a standby mode and an operational mode. A coin is received in the meter and a signal is generated upon receipt of the coin. An interrupt logic circuit places the microprocessor in the operational mode from the standby mode upon receiving the coin signal. An oscillator is connected to the microprocessor and to the interrupt logic circuit and is utilized for the timing function. The meter also has a plurality of coin detectors, wherein the coin sequentially passes these detectors without substantially stopping or contacting the detectors. The detectors may comprise a hall-effect ferrous metal detector, an infrared LED and large area photodiode system for detecting the diameter of the coin, and a frequency shift metallic detector. An electronic display is connected to the microprocessor and displays pertinent information for the meter.

The electronic meter may also have a reset logic circuit for placing the microprocessor into the power-up mode. The auditor may be connected to the microprocessor in the electronic meter by means of a direct cable link or by infrared transmission. The auditor supplies information and programming to the meter and collects data from the meter. The auditor may be a hand-held computer which is programmed appropriately for the parking meter.

Also, the electronic parking meter system may have a sonar range finder connected to the microprocessor in the meter which detects the presence or absence of a vehicle in an associated parking space with the parking meter.

BRIEF DESCRIPTION OF THE DRAWINGS

The features of the present invention which are believed to be novel, are set forth with the particularity in the appended claims. The invention, together with further objects and advantages, may best be understood by reference to the following description taken in conjunction with the accompanying drawings, in the several figures of which like reference numerals identify like elements, and in which:

DESCRIPTION OF THE PREFERRED EMBODIMENT

The present invention has general applicability but is most advantageously utilized in a parking meter for use with an associated space in which a vehicle may park. It is to be understood, however, that the present invention or portions thereof may be used for a variety of different applications wherever a paid timing function is to be utilized.

Figure 14A:
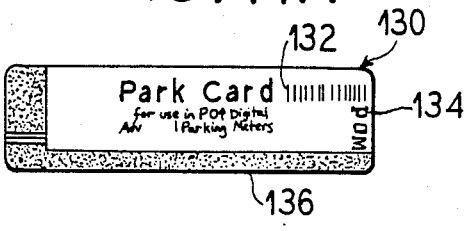
FIGS. 14A and 14B depict front and back views of a credit card type element for use with the FIG. 1 meter.
Figure 14B:
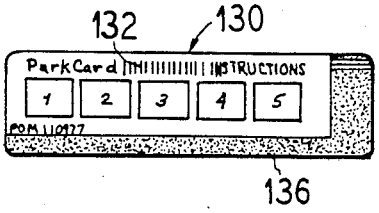

In general terms, the novel electronic parking meter system of the present invention is utilized to receive one or more types of coins. It is to be understood, however, that the meter could also be adapted to receive paper money or a credit card, such as depicted in FIGS. 14A and 14B. The electronic parking meter has a power supply which is connected to a microprocessor which has a memory. The microprocessor typically has a power-up mode, a standby mode and an operational mode. A coin signal generator produces a coin signal upon receipt of a coin by the meter. After receiving the coin signal an interrupt logic circuit places the microprocessor in the operational mode from the standby mode. An oscillator is connected to the microprocessor and to the interrupt logic circuit. The meter has a plurality of coin detectors and the coin sequentially passes these detectors without substantially stopping or contacting the detectors. An electronic display is connected to the microprocessor for displaying pertinent information such as money deposited, time remaining on the meter, etc.

The meter also has a reset logic circuit for placing the microprocessor in a power-up mode which is typically utilized when the meter is first placed in operation. The reset logic circuit is connected at least to the microprocessor. Furthermore, the meter may have an interface for connecting an auditor. The microprocessor and the auditor exchange information such as programming of the microprocessor from the auditor and sending data from the microprocessor to the auditor regarding money deposited in the meter and other operational parameters.

In addition, the meter may also has a sonar range finder system which detects the presence or absence of a vehicle in an associated parking space. Sonar range finder system is connected to the microprocessor for operation.

When the electronic parking meter is first placed into operation, the reset circuitry is activated, for example by the auditor, and causes the microprocessor to be placed in a power-up mode. During the power-up mode, the microprocessor performs diagnostic tests on the components of the meter and also initializes any appropriate circuitry in the meter. In addition, an oscillator is activated and runs at a fixed frequency. The microprocessor may be programmed to accept different types of coins by inserting a coin a plurality of times through the meter during which the microprocessor samples signals coming from the coin detectors in the meter and "learns" which type of coins are to be accepted.

When the power-up mode is complete, the microprocessor is placed in a standby mode in which it is still connected with the power supply of the meter. Also during the standby mode, the oscillator continues to be operational. When a coin is placed into the meter a signal is sent to the microprocessor which causes it to change from standby mode to the operational mode. As the coin falls through the meter, the coin detectors send appropriate signals to the microprocessor. The information regarding the amount of coins entered into the meter and the amount of time the meter will run, as well as, any other pertinent parameters is displayed on a display device connected to the microprocessor. During the timing function of the meter, the microprocessor is intermittently placed in the operational mode from the standby mode to update the time display and to identify when the timing has reached zero. Furthermore, the time display has an additional internal oscillator which may be instructed to flash an element of the display, such as a no parking signal, while the microprocessor is in the standby mode.

When the meter is equipped with a sonar range finder, the microprocessor, when it intermittently enters its operational mode, will cause the sonar range finder to determine if the vehicle is still present in the associated space. If the vehicle is not detected, the microprocessor then causes the meter to return to zero.

The auditor unit utilized with the electronic parking meter forms a part of the electronic parking meter system and is utilized to exchange data and information with the parking meter. Typically, this would include programming the parking meter to change the amount of time per type of coin inserted in the meter, and to collect data from the meter, such as the amount of money deposited and operational parameters of the meter. The auditor unit may be a hand-held general purpose computer which is equipped either with a cable for direct connection to the meter or with an infrared transmitter receiver system so that the auditor may be interfaced to the electronic parking meter from a distance. This is advantageous when an attendant desires to interface with the electronic parking meter while remaining in a vehicle. A feature of the present invention is that when the auditor unit is connected by a cable to the electronic parking meter, the cable may be utilized to provide electrical power to the meter to recharge the meter's power supply or to activate the microprocessor.

Figure 1:
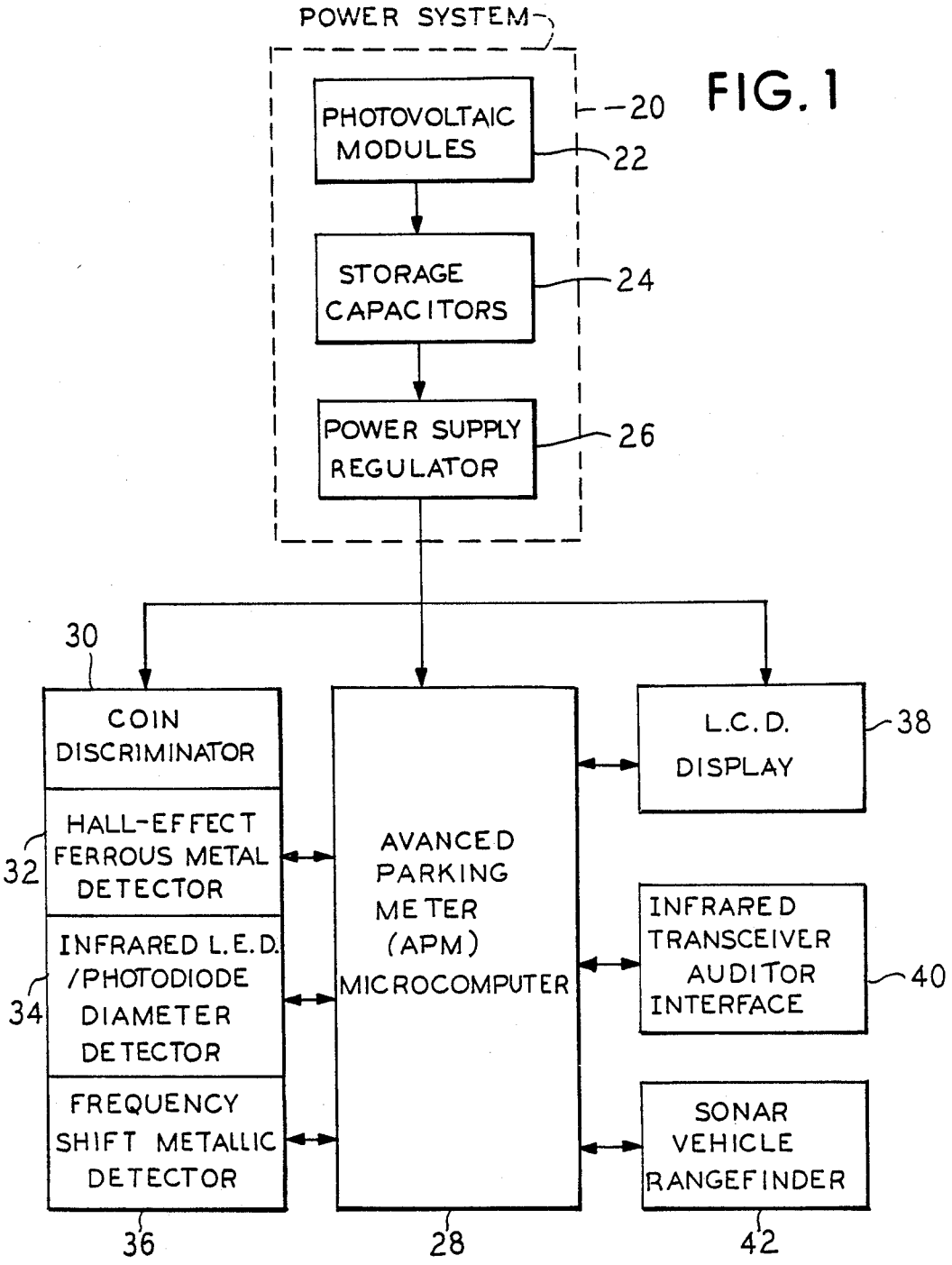
FIG. 1 is a general block diagram of the electronic parking meter system.

FIG. 1 shows a general block diagram of the electronic parking meter system. A power supply 20 has, in the preferred embodiment, solar cell arrays 22 for providing a cell voltage to a series of storage capacitors 24. The cell voltage causes the storage capacitors to be charged to a capacitor voltage. A power supply regulator 26 is connected to the storage capacitors 24 and provides the regulated voltage for use by the electronic parking meter components.

Central to the electronic parking meter is a microprocessor 28. The microprocessor 28 is connected to a coin discriminator 30 which sends a signal to the microprocessor when a coin is received by the meter. The microprocessor 28 then receives the signal from three coin detectors 32, 34 and 36 which identify the type of coin received by the meter. The detector 32 in the preferred embodiment detects any ferrous metal content of a coin using a Hall-effect ferrous metal detector. The diameter of a coin is detected by an infrared LED and photodiode system 34. The metallic content of the coin is detected by a frequency shift metallic detector 36. After the microprocessor 28 has determined the type of coin deposited and identifying it as a valid coin, the microprocessor 28 displays the pertinent information in a liquid crystal display unit 38.

As discussed above, an auditor having an infrared transceiver 40 may be interfaced with the microprocessor 28 of the electronic parking meter. Also, a sonar range finder 42 may be connected to the microprocessor 28.

Figure 2:
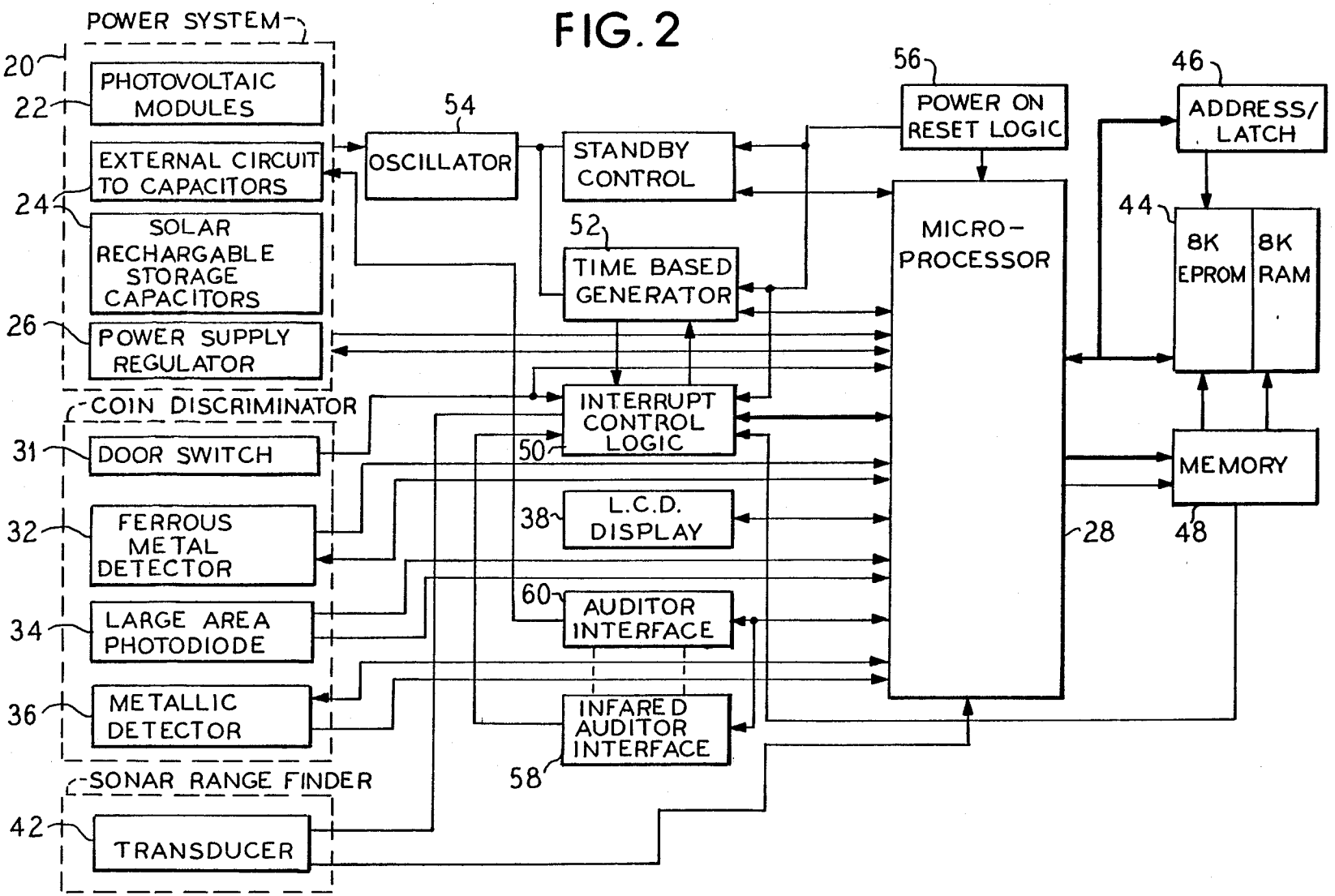
FIG. 2 is a more detailed block diagram of the FIG. 1 electronic parking meter system.

FIG. 2 shows a more detailed block diagram of the FIG. 1 meter. As is known in the art, the microprocessor 28 may have an appropriate memory 44 connected to it with associated address and latch registers 46 and read-write and address decode logic 48. Interrupt control logic 50 is provided to receive the coin signal from the coin signal generator 31 and is connected to the microprocessor 28. When the coin signal is received by the interrupt control logic 50, it causes the microprocessor 28 to enter the operational mode from the standby mode. Also, the time base generator 52 is connected to the interrupt control logic 50 and to the microprocessor 28 and generates signal therebetween which result from the time being counted to zero. The microprocessor 28 is connected to the power supply 20 so that it receives a minimal amount of power in its standby mode. In addition, a fixed oscillator 54 is also connected to the power supply 20 and runs continuously, even when the microprocessor 28 is in the standby mode. Power-on reset logic 56 is provided to place the microprocessor in the power-up mode when the meter is first placed in operation or if the meter has to be reprogrammed.

The standby oscillator control 55 is the electronic divider circuits which divide down the frequency of the fixed oscillator 54 to provide the microprocessor with its timing signal. The time base generator 52 provides a time signal, when the meter is running, for the microprocessor 28 to periodically be placed in the operational mode from the standby mode and update the display 38.

The coin signal generator 31 may be a door switch, which is a normally closed magnetic reed switch. Depositing a coin causes the reed switch to open thereby providing the coin signal.

As shown in FIG. 2, the auditor may have the infrared interface 58 or may have a direct connection 60 with the meter. In the direct connection embodiment 60, the auditor also has a connection to the power supply 20 for charging the storage capacitors 24 therein, as well as, providing immediate power to the microprocessor 28 when necessary.

Figure 3:
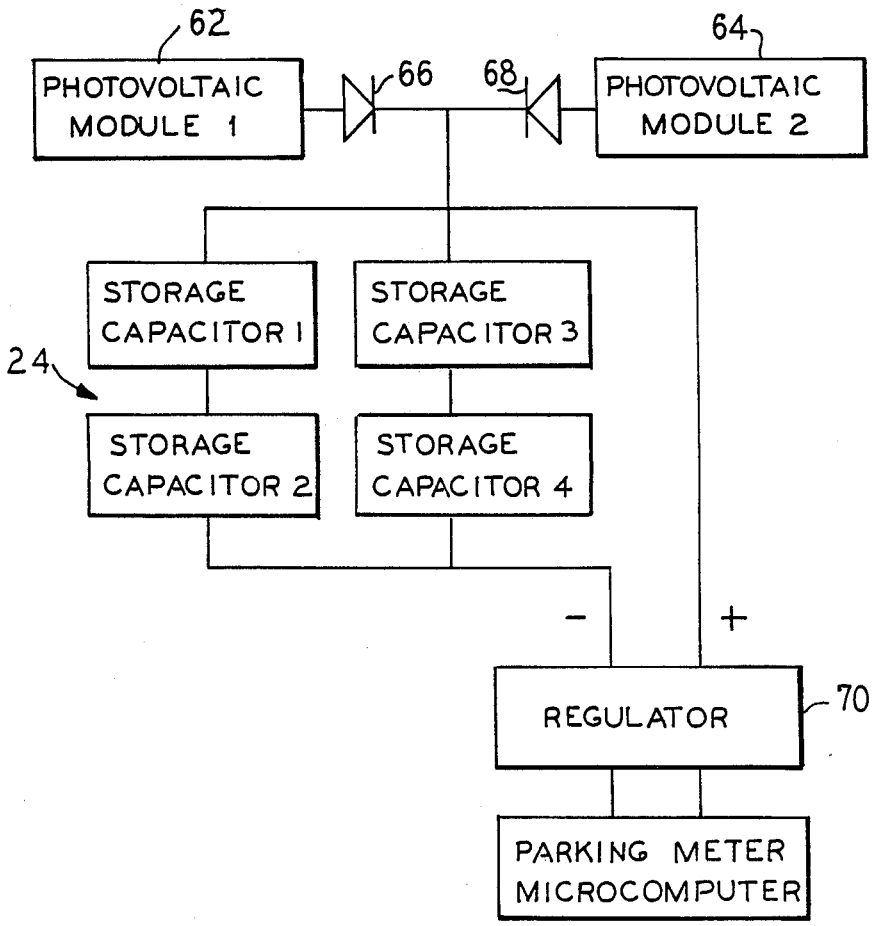
FIG. 3 is a general block diagram of a solar power supply used in the FIG. 1 meter.

FIG. 3 shows a more detailed block diagram of the power supply 20. The power supply 20 has first and second solar cell arrays 62 and 64 which are connected by low leakage blocking diodes 66 and 68 to storage capacitors 24. In the preferred embodiment, at least first and second series connected storage capacitors 24 are connected to the solar cell arrays 62 and 64. The voltage both from the storage capacitors 24 and from the solar cell arrays 62 and 64 is applied to the regulator circuit 70.

Figure 4:
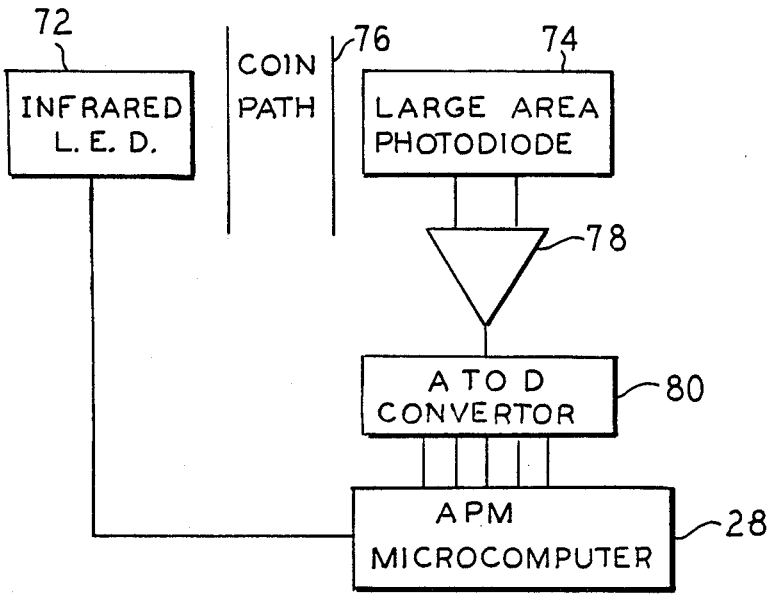
FIG. 4 is a general block diagram of a coin diameter detector used in the FIG. 1 meter.

FIG. 4 show in general block diagram form the infrared LED/photodiode diameter detector 34 for detecting the diameter of a coin. The coin falls past the infrared light emitting diode 72 and past the large area photodiode 74 along the coin path 76. The microprocessor 28 has been programmed such that the output of the photodiode 74, which is connected to an operational amplifier 78 and converted from an analog to a digital signal by converter 80, identifies the type of coin by its diameter.

Figure 6:
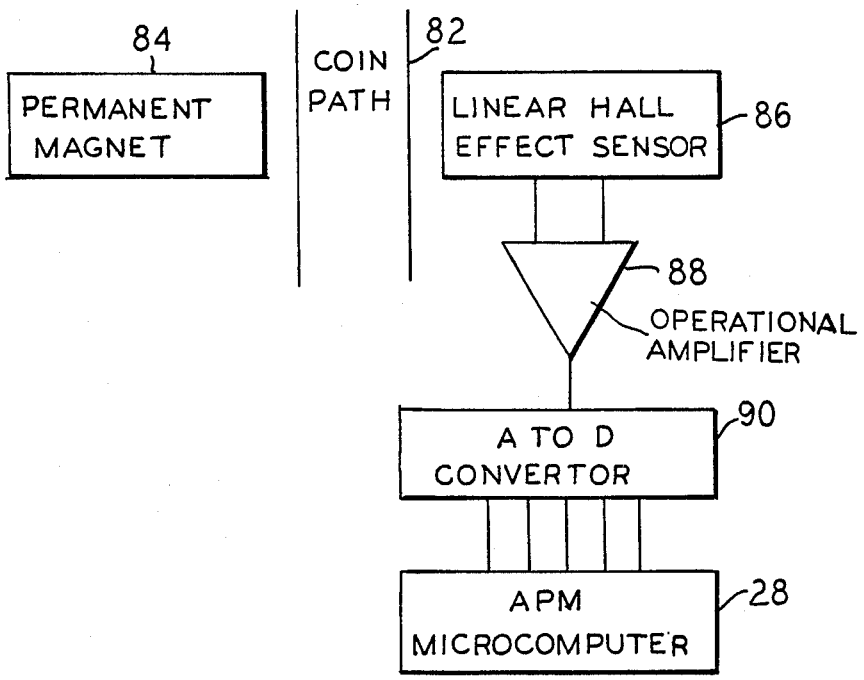
FIG. 6 is a general block diagram of a Hall-effect ferrous metal detector used in the FIG. 1 meter.

FIG. 6 shows in general block diagram form the Hall-effect ferrous metal detector. As the coin follows coin path 82, it falls between a permanent magnet 84, and a linear Hall-effect sensor 86, which outputs a signal to an operational amplifier 88, which is connected to an analog-to-digital converter 90. The signal from the converter 90 is received by the microprocessor 28 and the microprocessor 28 has been programmed to recognize signals which represent valid coins.

Figure 5:
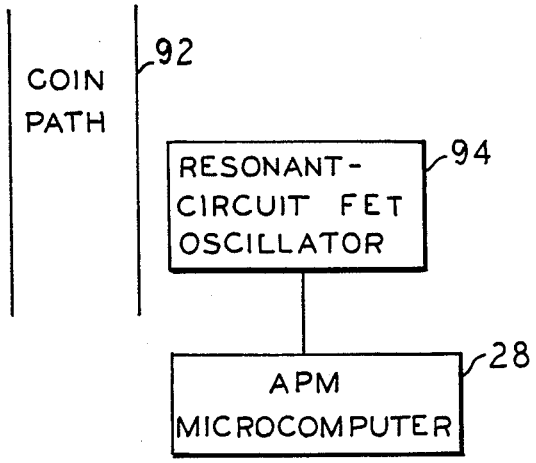
FIG. 5 is a general block diagram of a frequency shift metallic detector used in the FIG. 1 meter.

FIG. 5 is a general block diagram of the frequency shift metallic detector which recognizes whether the coin has a metallic content or not. The coin falls along the coin path 92 and influences the resonant field effect transistor circuit oscillator 94 which outputs a representative signal to the microprocessor 28 from which the microprocessor 28 can identify if the coin is metallic.

Figure 7:
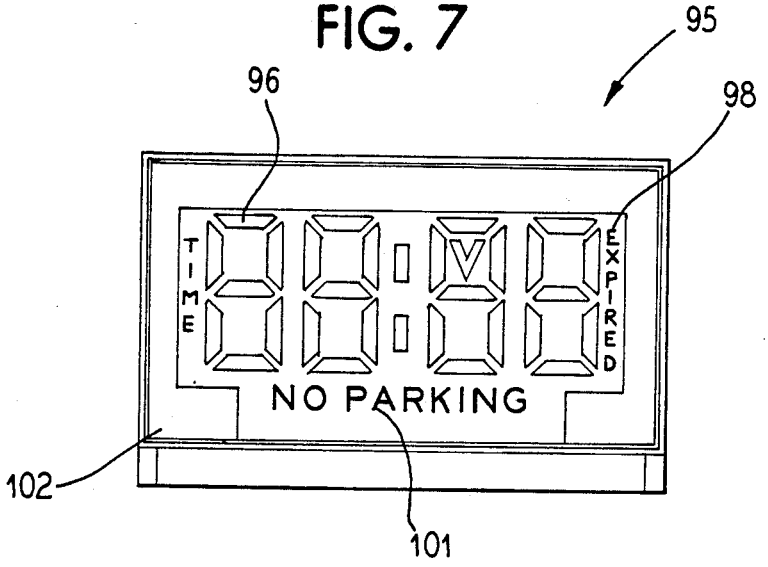
FIG. 7 is a plan view of the LCD display device used with the FIG. 1 meter.

FIG. 7 shows a preferred embodiment of the liquid crystal display 95 of the liquid crystal display unit 38 utilized in the electronic parking meter of the present invention. The display 95 has the standard liquid crystal arrangement for displaying numbers 96. Furthermore, various information such as time expired 98, and no parking 100 can also be activated and displayed. In addition, the border 102 of the display can be activated to signal a time expired, for example.

Figure 10:
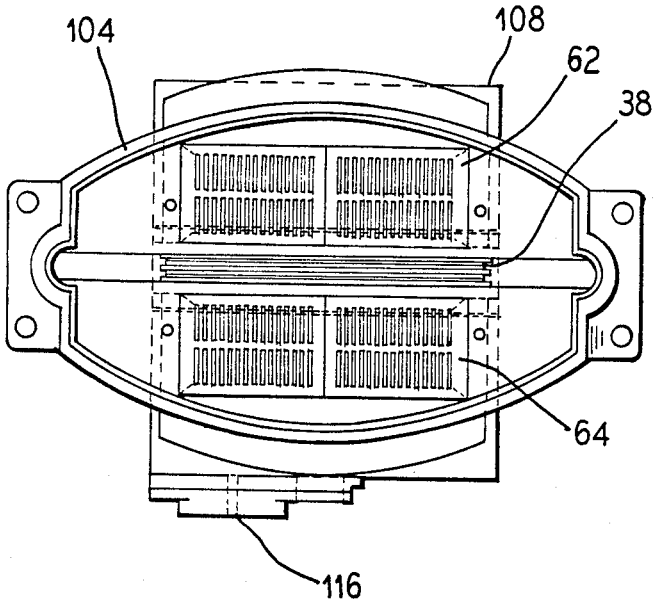
FIG. 10 is a top view of the FIG. 8 meter.
Figure 9:
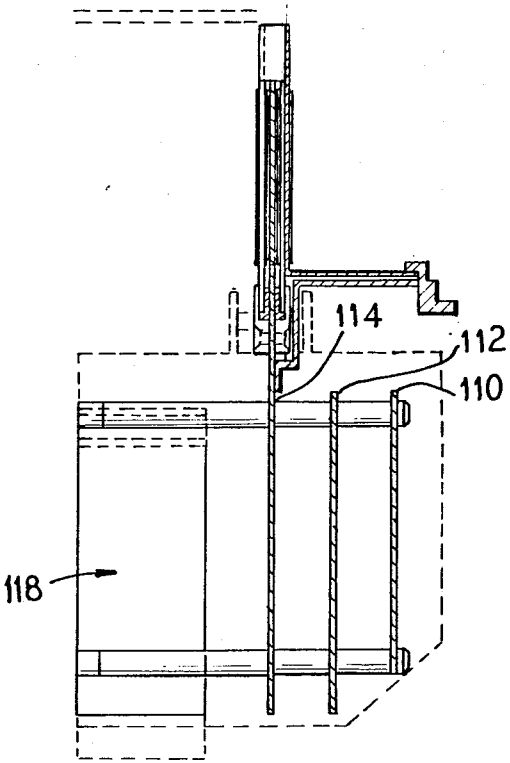
FIG. 9 is a side view of the interior portions of the FIG. 8 meter.
Figure 8:
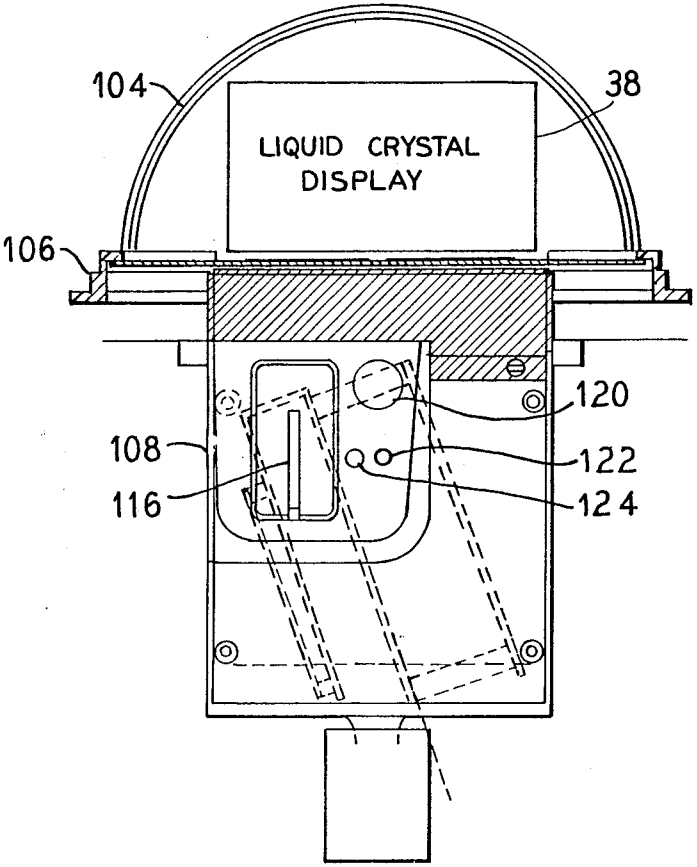
FIG. 8 is a front view of the housing for the FIG. 1 meter.

FIGS. 8, 9 and 10 show various views of the parking meter and its internal physical construction. As can be seen in the figures, the liquid crystal display 38 is visible through a transparent dome 104 which is attached to the top support member 106 of the meter. A housing for the meter 108 contains electronic circuit boards 110, 112 and 114. A coin slot 116 is provided in which the coin is placed and falls down a coin shoot 118 past the coin detector. An aperture 120 is provided on the front of the housing and contains the infrared transmitter and receiver elements for interfacing with the hand-held auditor. In addition, the sonar range finder transmitter and receiver transducers 122 and 124 may be incorporated into the front of the housing 108.

Located on either side of the liquid crystal display 38, are the solar cell arrays 62 and 64. They are exposed to sunlight through the transparent dome 104. The solar cell arrays 62 and 64 are placed on either side of the liquid crystal display 38 to optimize their exposure to sunlight.

Figure 11:
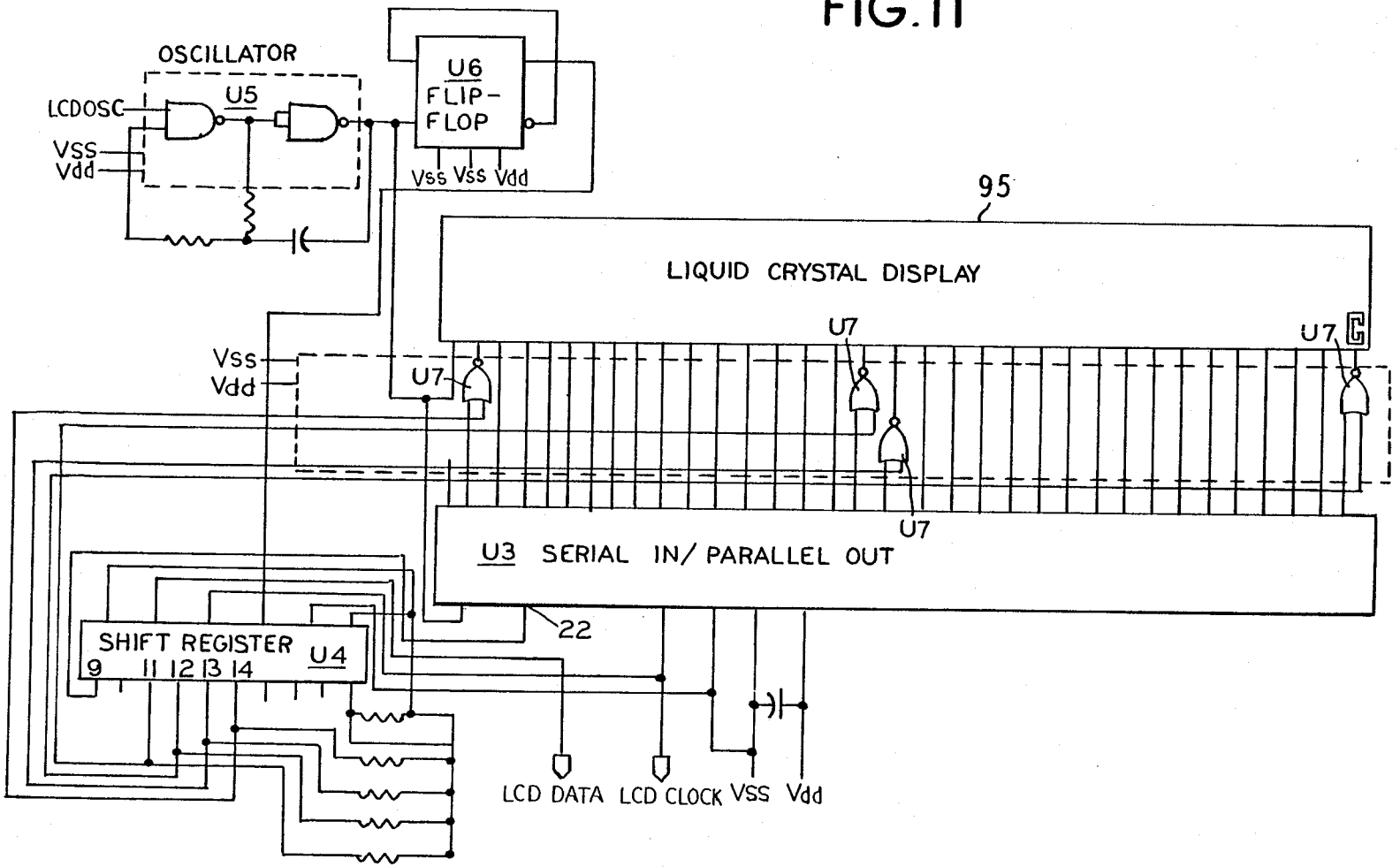
FIG. 11 is a circuit schematic for the liquid crystal display device used in the FIG. 1 meter.

Included with the liquid crystal display unit 38 is an associated electronic circuit shown in FIG. 11. Connected to the liquid crystal display 38 is a serial in/parallel out integrated circuit, U3, which provides the connections to each of the elements of the liquid crystal display. The integrated circuit U3 receives its data in on input 22 which is connected through a shift register U4 to the microprocessor 28 on the input designated LCD DATA. Also received from the microprocessor 28 on the input designated LCD CLOCK is an appropriate timing signal for clocking the integrated circuit U3 and the shift register U4. In general, elements of a liquid crystal display are activated by signals appearing on pin 9 of the shift register U4. However, it is also possible to activate in the flashing mode selected items in the liquid crystal display 95, such as time expired, the colon, no parking, or the border. Each of these selected elements in the display 95 is connected to one of pins 11 through 14 in the shift register U4 and to an oscillator circuit comprising oscillator U5 and a flip-flop U6. The oscillator U5 receives an input signal on the input LCDOSC from the microprocessor 28. The oscillator U5 in then activated and runs flip-flop U6 which provides an output to the liquid crystal display 95 which in conjunction with exclusive-OR gates U7 causes the selected element to flash, even when the microprocessor 28 is in the standby mode. In the preferred embodiment oscillator U5 operates at 1 Hz and flip-flop U6 functions as a divide by two counter. Thus, this feature allows the electronic parking meter to be placed into a mode which flashes no parking, for example. Since the microprocessor is in the standby mode, the current drain on the power supply 20 is kept to a minimum.

Figure 12:
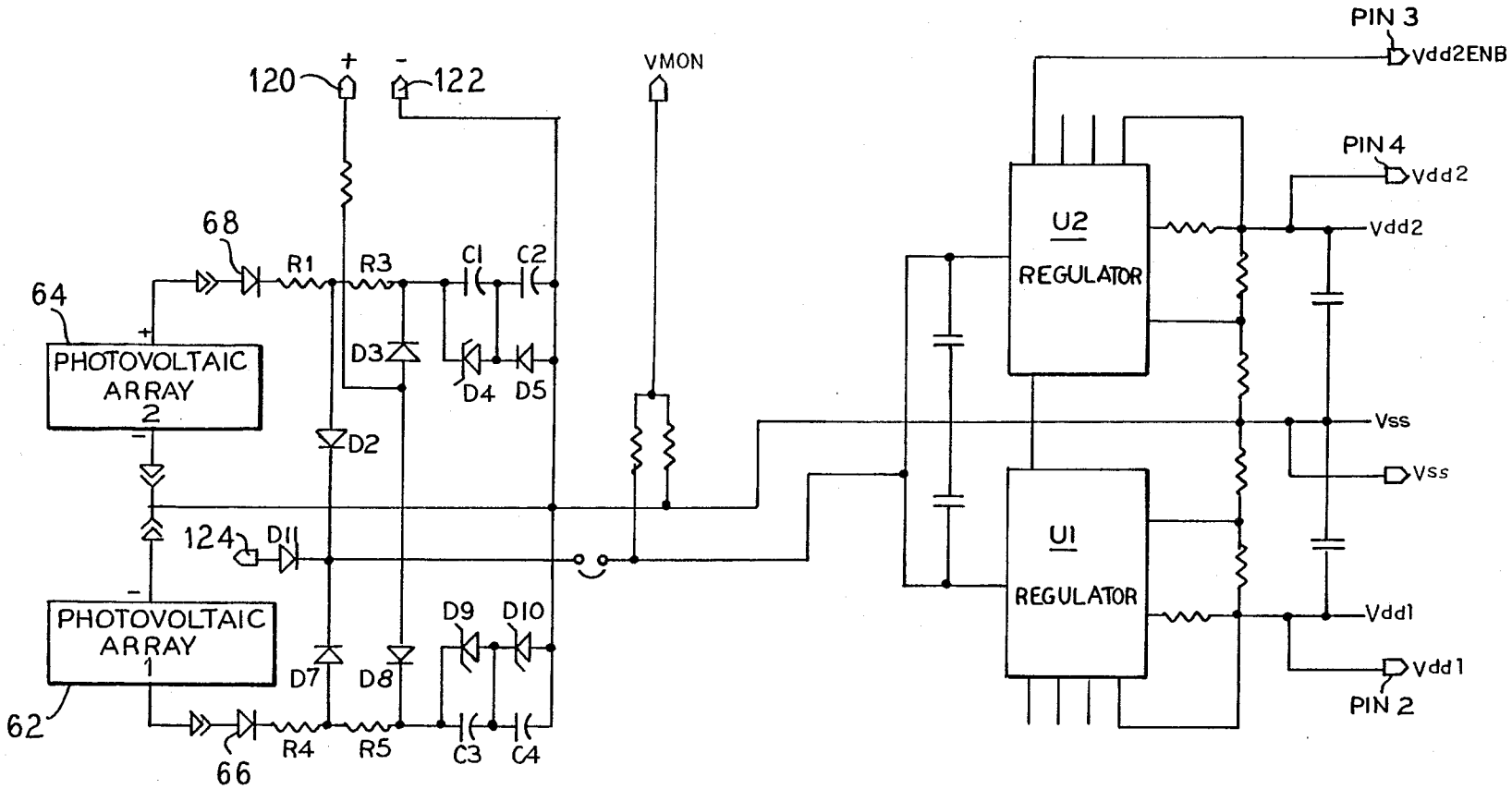
FIG. 12 is a circuit schematic for the power supply used in the FIG. 1 meter.

FIG. 12 shows a schematic circuit for the power supply 20. Solar cell arrays 62 and 64 have their negative terminals connected together and have associated low leakage blocking diodes 66 and 68. Capacitors C1 and C2 are connected in series between the positive terminal of array 64 and its negative terminal. Similarly, capacitor 63 and 64 are connected in series between the positive terminal of the array 62 and its negative terminal. The arrays 62 and 64 are essentially connected in parallel for charging the capacitors. Zener diodes D4, D5, D9 and D10 are connected across the capacitor C1, C2, C3 and C4, respectively, to provide for even charging of the capacitors. This provides that if one capacitor in the series charges to its preset maximum capacitor value before the other capacitor does, the Zener diode on the first capacitor will begin conducting allowing the second capacitor to fully charge without overcharging the first one. Resistors R1, R3, R4 and R5 are supplied in the circuit to connect the solar cell arrays 62 and 64 to the capacitors C1 through C4. These resistors provide that current may flow not only to the capacitors from the solar cell array 62 and 64, but also may flow to the regulators U1 and U2 so that the electronic parking meter may be energized directly from the solar cell arrays 62 and 64. This is advantageous, for example, when the meter has completely discharged capacitors when the meter is first put out into sunlight. The meter will then be able to begin operation immediately while the capacitors are being charged by the solar cell arrays 62 and 64. In addition, terminals 120 and 122 are connected across the capacitors C1 through C4, as well as, connected to resistors R3 and R5. The terminals 120 and 122 may be utilized to be connected to an external source of power for quick charging the capacitors C1 through C4, as well as, simultaneously powering the electronic parking meter. Also, the terminal 124 may be supplied for connection to an auxiliary battery for supplying power. Diodes D2, D3, D7, D8 and D11 function as appropriate blocking diodes for current flow.

Unregulated DC voltage from the capacitors C1 through C4, as well as, from the solar cell array 62 and 64 are supplied to two regulators U1 and U2. These regulators generate regulated voltage for use by the electronic parking meter. The regulator U1 is utilized to supply regulated voltage to the microprocessor 28 on pin 2, $V_{DD1}$. U2 supplies regulated voltage on pin 4, $V_{DD2}$ to peripheral items such as the coin detectors 32, 34 and 36. U2 has an input pin 3, $V_{DD2ENB}$ upon which a signal may be received from the microprocessor 28 to turn the regulator U2 on and off. Thus, the power may be removed from the coin detectors 32, 34 and 36, as well as, any other selected peripheral device when the microprocessor 28 is in a standby mode. Once the microprocessor 28 enters the operational mode, a signal is sent to regulator U2 which turns on the power to the peripheral items.

Figure 13:
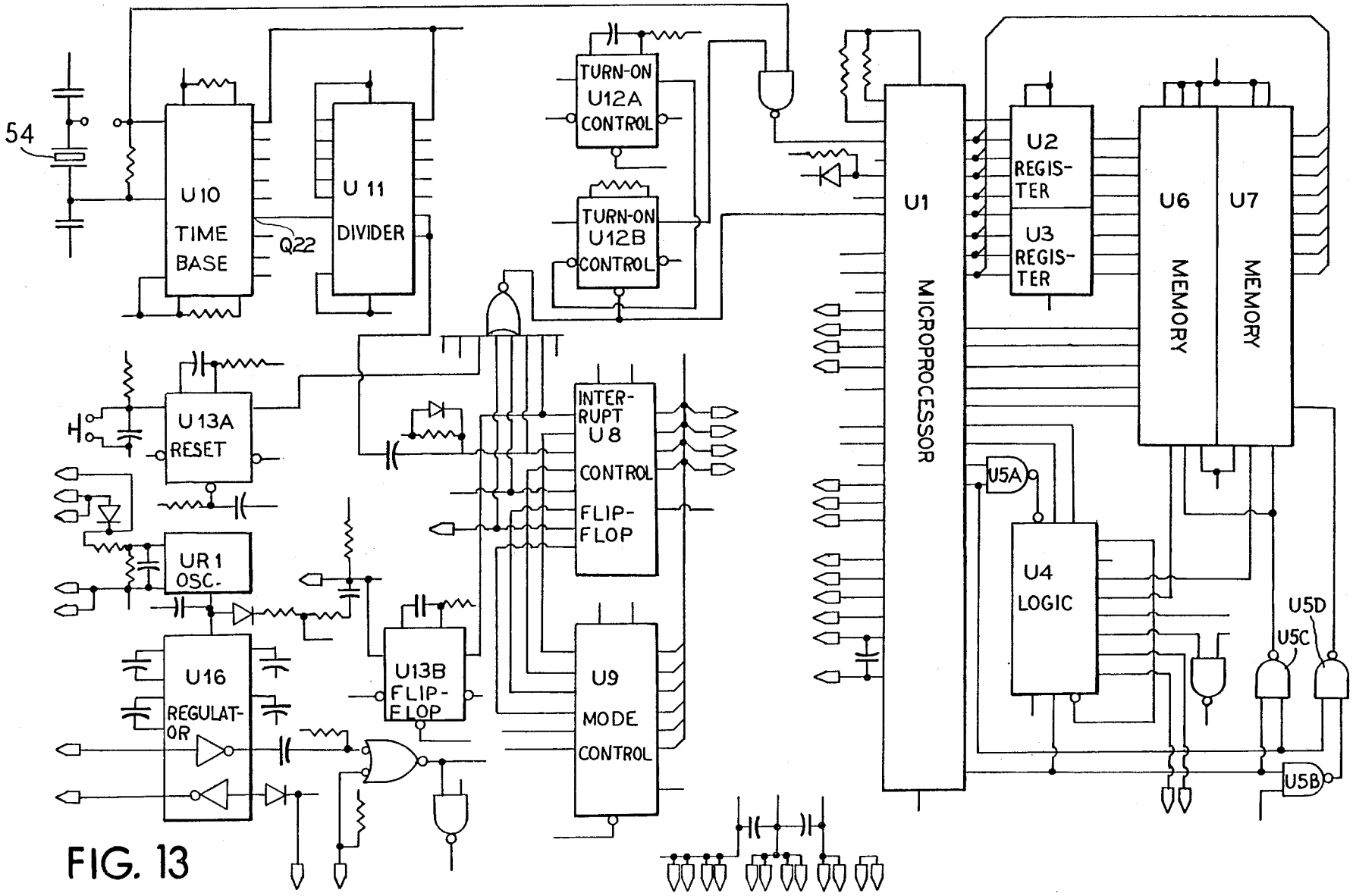
FIG. 13 is a circuit schematic of the microprocessor associated circuitry used in the FIG. 1 meter.

FIG. 13 shows a detailed schematic diagram of the electronic parking meter exclusive of the power supply 20 and the liquid crystal display unit 38. Central to the electronic parking meter is the microprocessor U1 and its associated memory units U6 and U7 connected to the processor U1 through address and latch registers U2 and U3 and the memory read-write and address decode logic, U4 and U5A through U5D. In the preferred embodiment the microprocessor utilized is a Motorola computer, MC 68 HC 118, which has the features of a power saving stop and wait modes, and 8 Kbytes of ROM, 512 bytes of EEPROM, and 256 bytes of static RAM.

The oscillator 54 is a 1.048576 MHz oscillator and is utilized to operate the electronic parking meter. The oscillator runs continuously, although it is provided through U10 with a reset mode. The reset mode of U10 corresponds to the standby mode of the microprocessor 28, such that although the oscillator 54 is running continuously, the internal dividers in the circuit U10 are disconnected so that only approximately 20 Microamps are necessary to operate the oscillator 54. The divider U10 provides the time base on output Q22 which is divided again by U11 to give approximately a 30 second delay or one minute interrupts. The output of U11 then goes to the interrupt control logic U8. U8 also receives signals from the coin signal generator which then causes the interrupt control logic U8 to send a signal to the microprocessor U1 to place it in an operational mode. U8 essentially operates as a flip-flop.

U13a is the reset circuitry which when activated to the power up mode, causes reset signals to be supplied to the system and also turns on the oscillator 54 in conjunction with U10 and U11. Furthermore, the reset logic circuit U13a causes the flip-flop U8 to place the microprocessor U1 in a power up mode. During the power up mode, the microprocessor U1 may run diagnostic checks and place the parking meter in condition for operation after which the microprocessor U1 will go into the standby mode. After the appropriate signals are received at U9 the output of U9 is utilized to place the microprocessor U1 in the standby mode. In the standby mode, the microprocessor U1 in the preferred embodiment draws approximately 40 microamps with its associated logic circuitry from the power supply 20.

In the operational mode, after a coin has been deposited, the microprocessor U1 receives signals from the coin detectors. One coin detector, the linear Hall-effect ferrous metal detector 32 is a differential amplifier device that gives an output proportional to the magnetic field which influence it. Thus, a slug or washer, for example, can be identified because it will disrupt the magnetic field around the detector 32. Similarly, the signals from the diameter detector 34 and the metallic content detector S6 are also supplied to the microprocessor U1. During the time the coin passes these detectors, the microprocessor is constantly scanning. The microprocessor in the preferred embodiment, samples the detectors approximately every 50 microseconds. Since the coin takes approximately 20 milliseconds to fall past a detector, each detector thereby supplies thousands of signals to the microprocessor. The microprocessor is therefore able to perform appropriate analysis of the signals for identifying the coin. The diameter detector has its infrared light emitting diode turned on for approximately 25 microseconds after which it is shut down and the information is conveyed to the microprocessor U1. This turning on and off of the detector continues to supply information to the microprocessor U1 identifies the coin diameter. The frequency shift metal detector is essentially a phase lock loop oscillator such that a metallic object will cause a phase shift in the frequency or the base line frequency and supply a signal to the microprocessor U1. The information from the three detectors is thus suitable for identifying a valid coin which is metallic, although not ferrous metallic and has a proper diameter.

Numerous types of sonar range finders are available and as one example, air ultrasonic transducers made by Projects Unlimited have a frequency range up to 60 KHz and come in various diameters up to 25 mm. As was described, the receiver and transmitter transducers 122 and 124 in FIG. 8 can be mounted in a side-by-side relationship and connected to appropriate transmitting and receiving circuits, such as Texas Instrument circuits type SN28827 or Texas Instrument sonar ranging control circuits type TL851 and TL852. Obviously any other type of sonar rangefinder could be used in the electronic parking meter. The circuits are then connected to the microprocessor 28. When the microprocessor 28 is in an operational mode, the sonar range finder is turned on and sends a signal to the microprocessor 28 which indicates the presence or absence of a vehicle in the parking space associated with the electronic parking meter. When the vehicle is no longer detected in the associated parking space, the microprocessor 28 may return the timing circuit to zero in the meter. In operation, the microprocessor 28 may be placed in the operational mode only intermittently while the timing function is occurring, thus, using the sonar range finder to sample, only during certain periods for the presence or absence of the vehicle.

Figure 15:
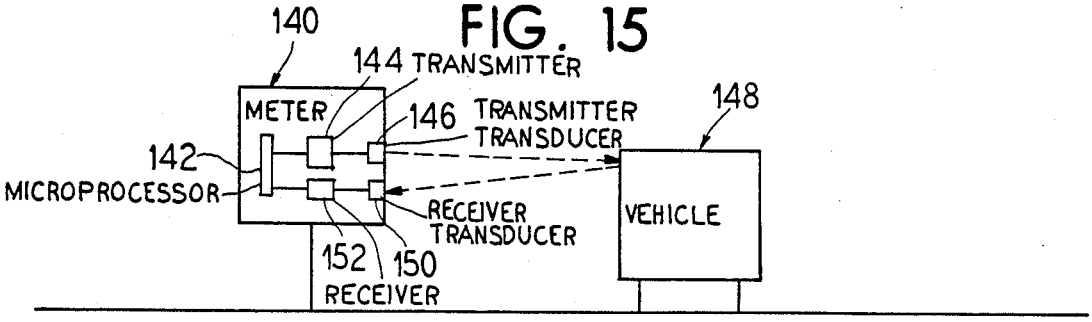
FIG. 15 is a schematic diagram of a sonar range finder used with the FIG. 1 meter.

As schematically depicted in FIG. 15, the electronic parking meter 140 has the microprocessor 142 which activates the sonar transmitter circuit 144. Transmitter transducer 146 then outputs the sonar signal which is reflected from vehicle 148. The echo is received by receiver transducer 150 which is connected to the receiver circuit 152. The receiver circuit 152 determines the presence or absence of the vehicle 148 from the echo signal and, if desired, can determine the distance between the vehicle 148 and the meter 140. The receiver circuit 152 provides the appropriate signal to the microprocessor 142.

The auditor unit utilized with the electronic parking meter to form an electronic parking meter system may be a special unit or may be a hand-held general purpose computer. These devices are typically sufficient to program the parking meter and or to extract the data from the parking meter.

Figure 16:
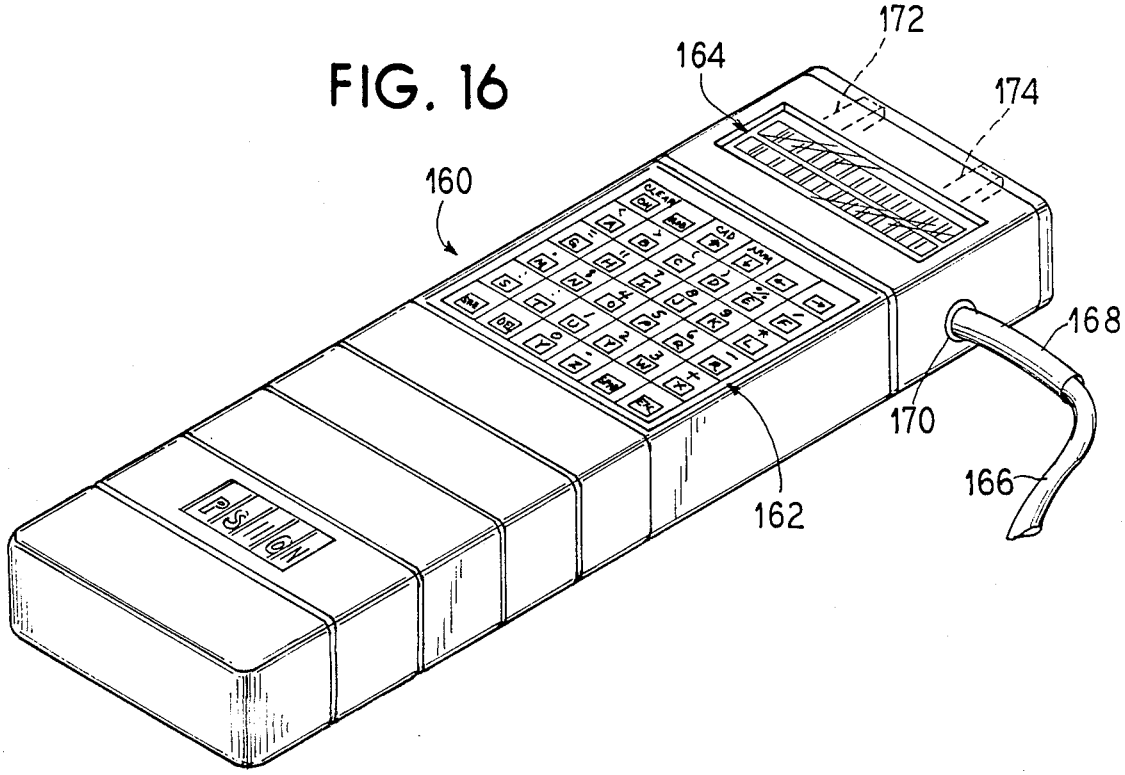
FIG. 16 is a perspective view of an auditor unit for use with the FIG. 1 meter.
Figure 17:
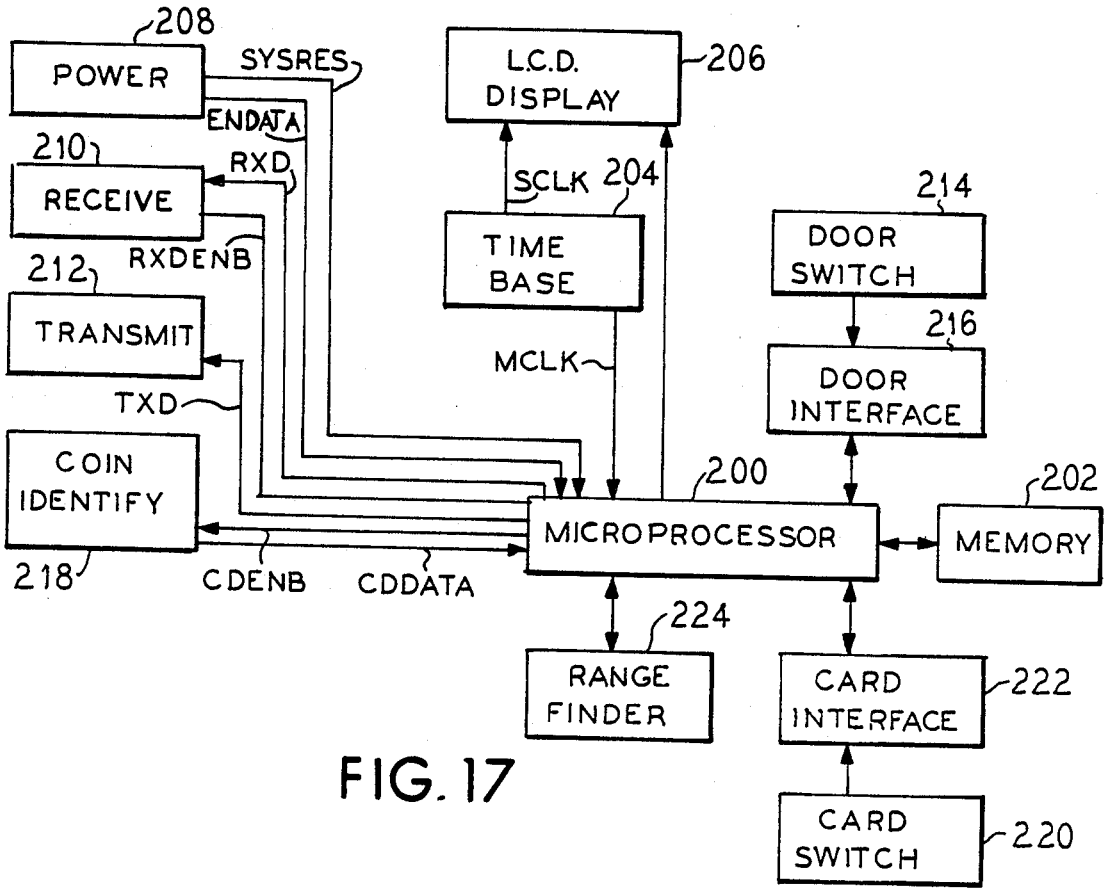
Figure 25:
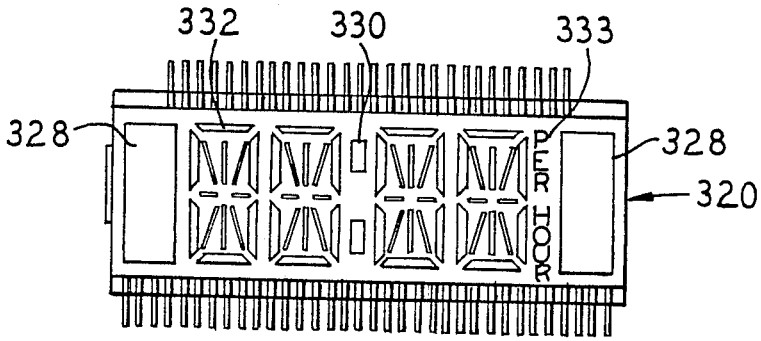
Figure 18:
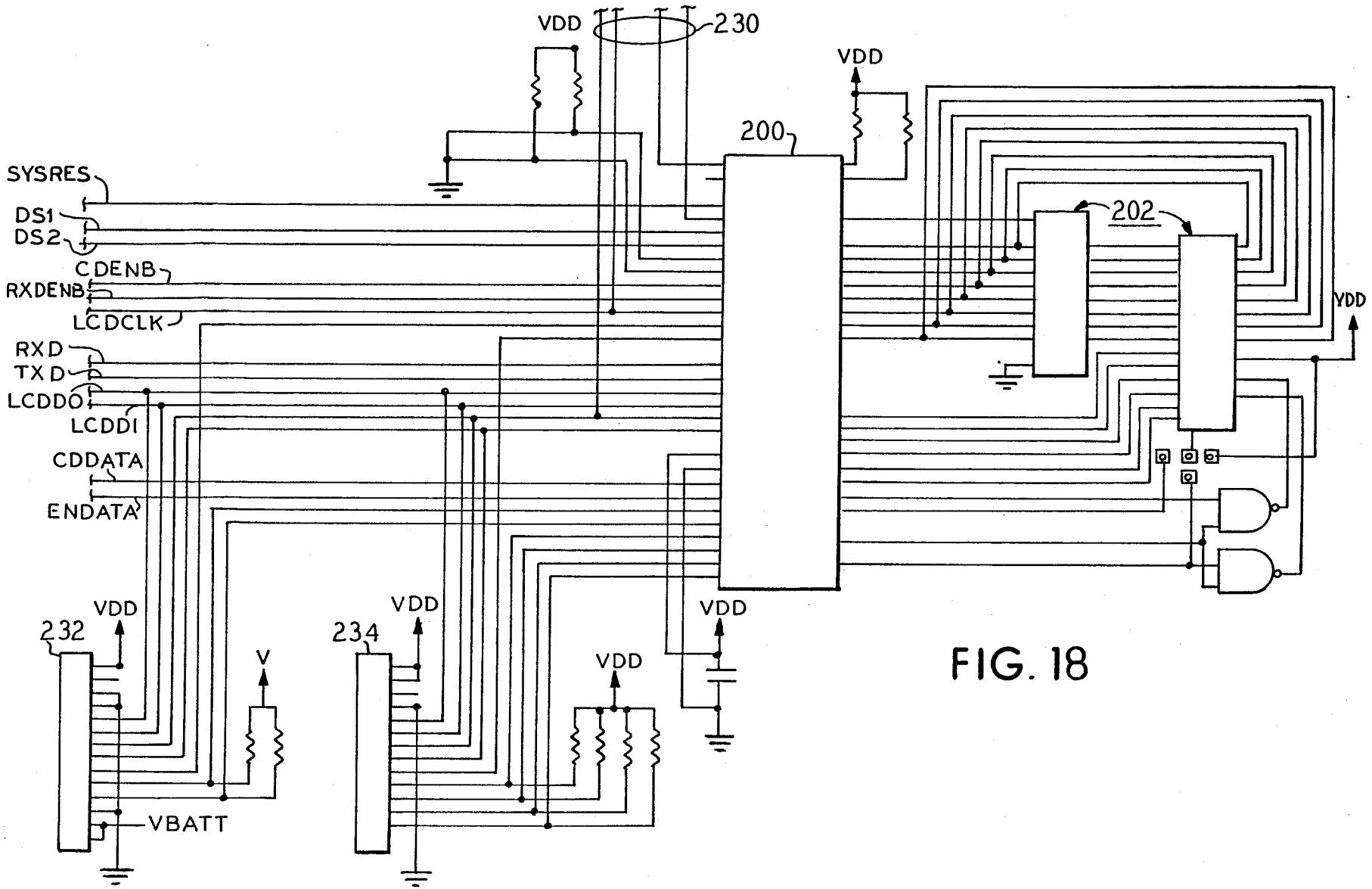
Figure 20:
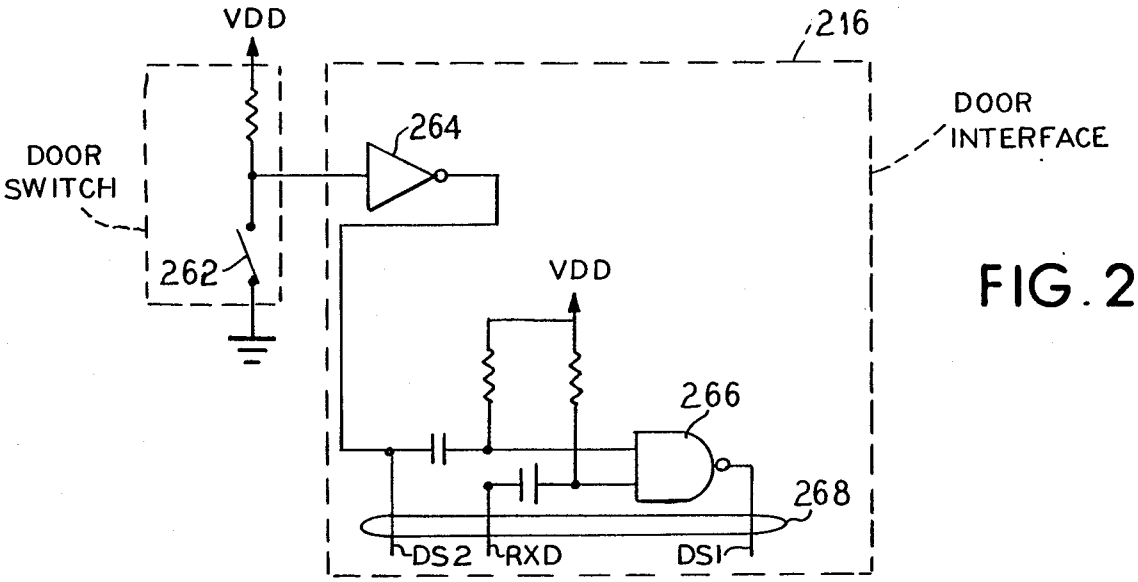
Figure 19:
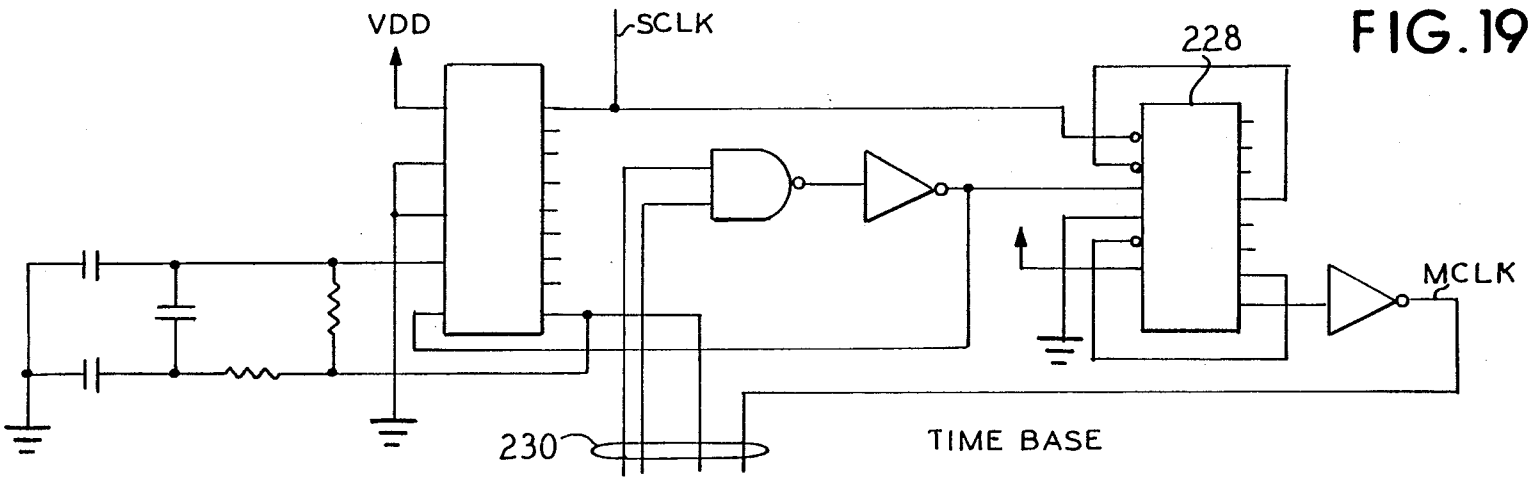
Figure 21:
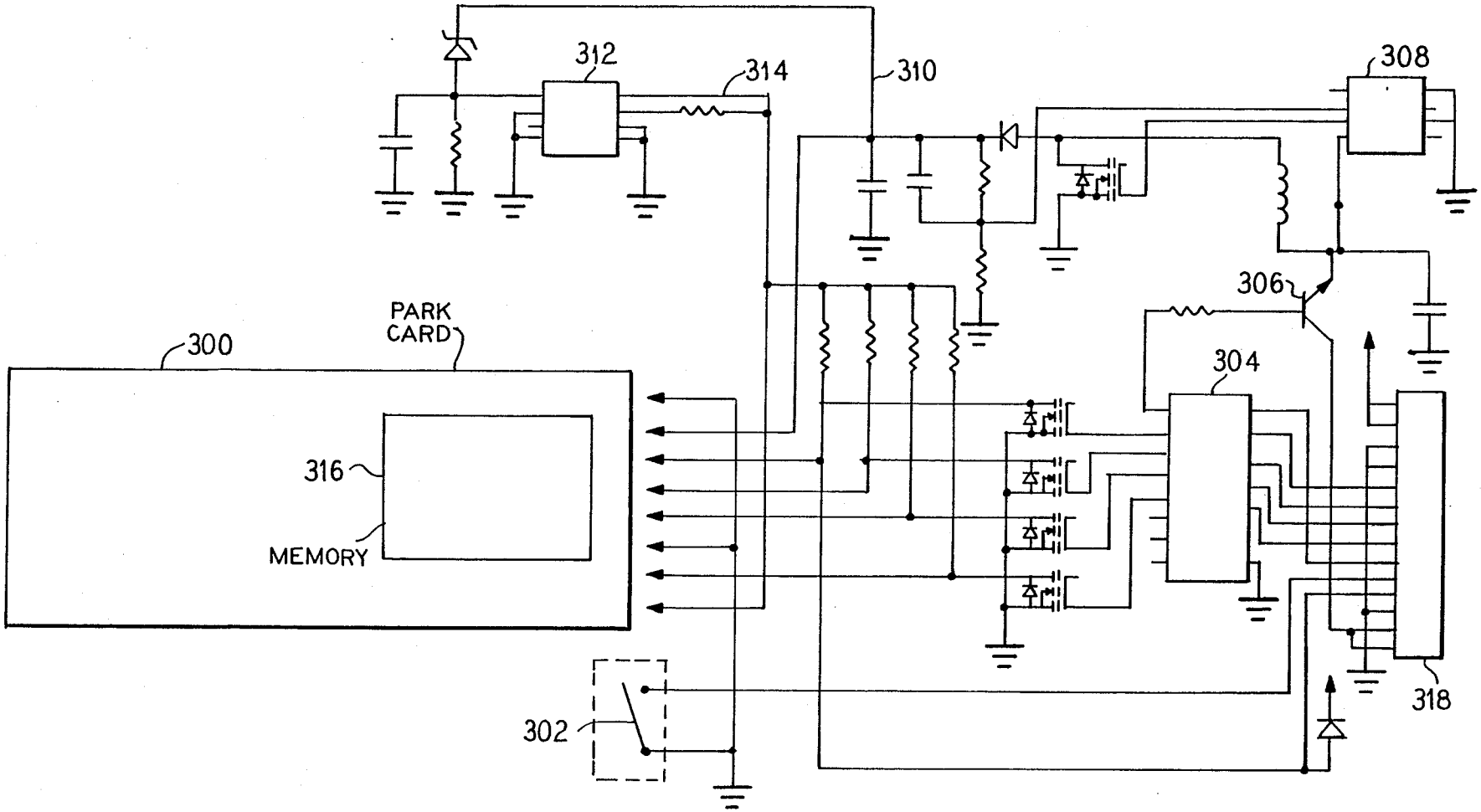
Figures 22A, 22B:
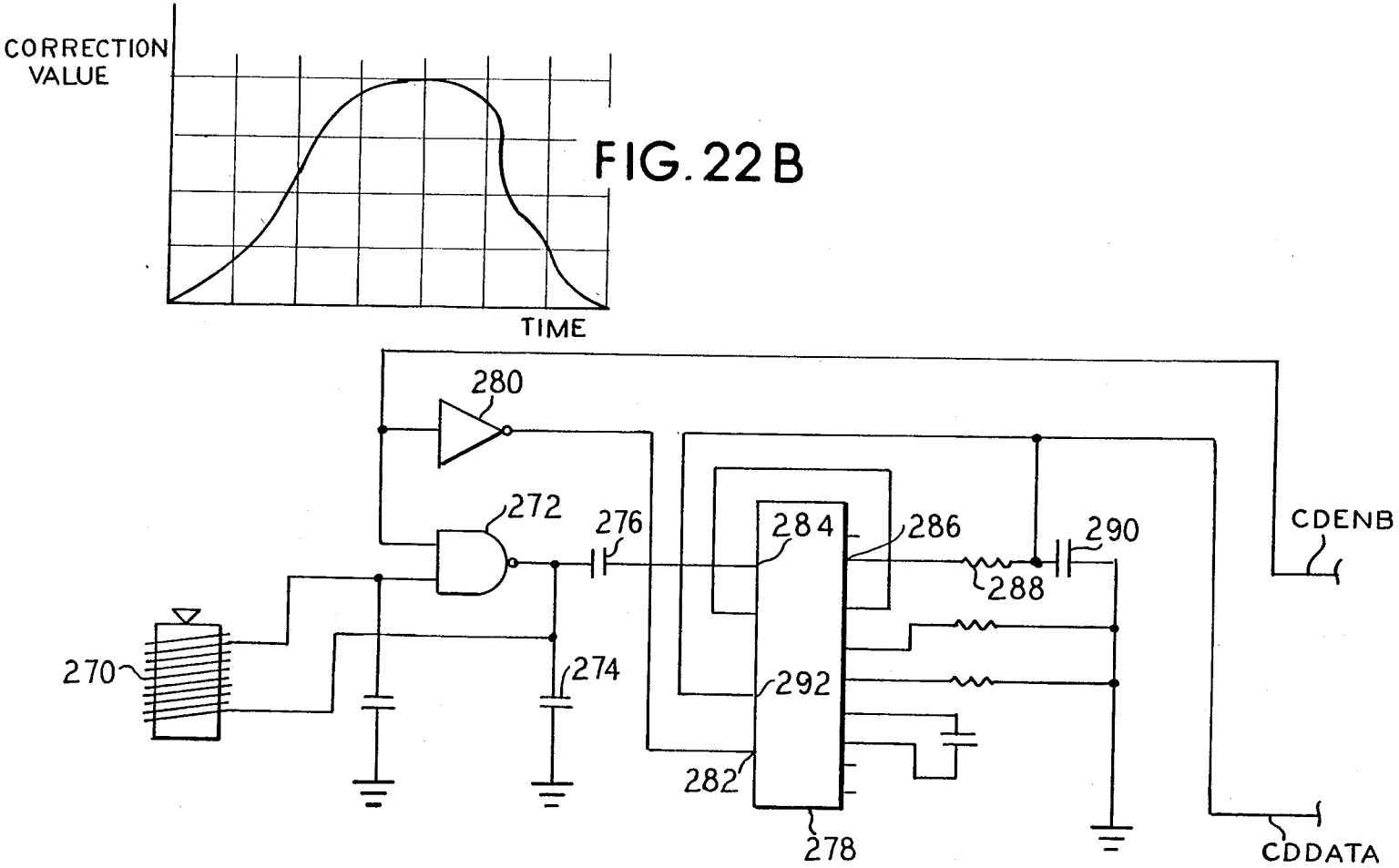
Figure 23:
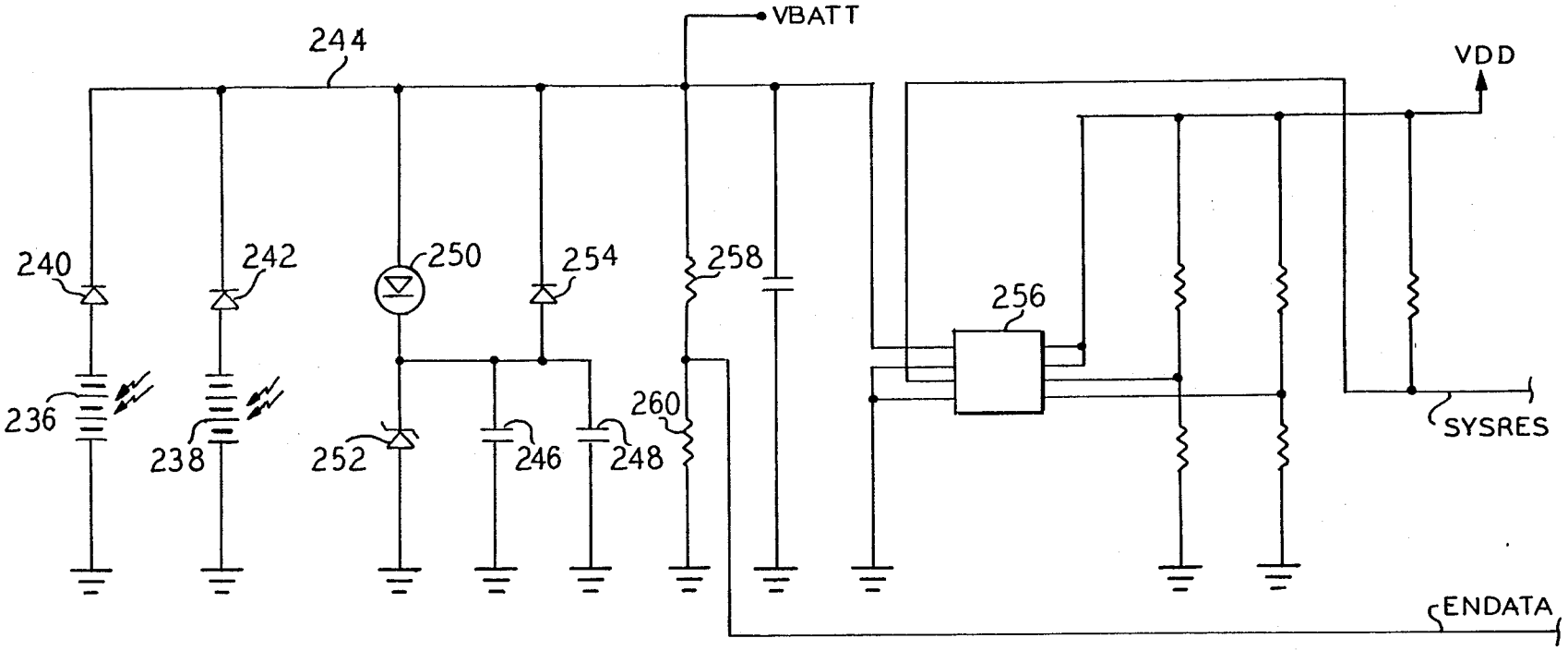
Figure 24:
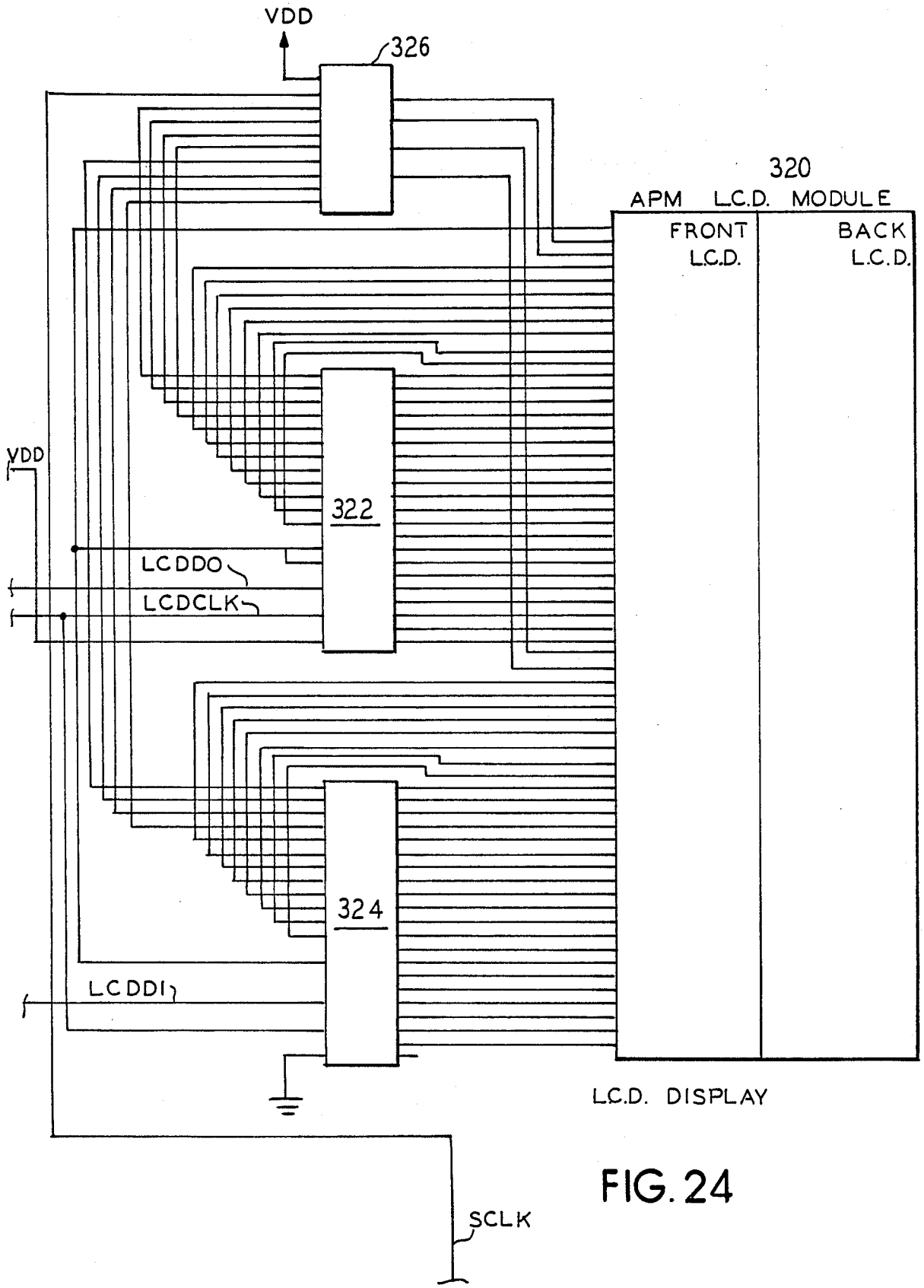

As shown in FIG. 16, the auditor 160 may have a keypad 162 for entry of information and a display 164. A cable 166 and plug 168 connect to socket 170 and provide direct connection between the auditor 160 and the meter. Alternatively, infrared transmitter 172 and receiver 174 may be utilized to interface with the meter.

Shown in FIGS. 14A and 14B, is a credit card type structure, which has a thin plastic or cardboard type body 130 on which information regarding the amount of parking time may be supplied in various forms, such as bar code 132, embossed symbols 134 or magnetic strip 136. The "park card" may be inserted into the electronic parking meter which has a device for appropriately reading the information stored on the park card. The card may be left in the meter until the liquid crystal display of the meter indicates the amount of time which the customer desires. As the card is removed, the meter would cause the card to be marked such that a certain amount of time has been used up from the card. Thus, at some point in time, the card would be completely used and would thereby be discarded. Obviously, it is envisioned that other types of charge card approaches could be utilized with the electronic parking meter. Thus, it should be understood that although in the preferred embodiment, the electronic parking meter receives a coin, the same function of the parking meter can be achieved with only minimal revisions in structure to accept, not only coins, but also paper money, normal charge cards or the above described "park card". Thus, in this disclosure the word, "coin", should be understood to also mean payment elements, such as paper money, credit cards, special "park cards", etc.

The invention is not limited to the particular details of the apparatus depicted and other modifications and applications are contemplated. Certain other changes may be made in the above described apparatus without departing from the true spirit and scope of the invention here and involved. It is intended, therefore, that the subject matter in the above depiction shall be interpreted as an illustrative and not in a limiting sense.

What is claimed is:

1. An electronic parking meter system for receiving at least one type of coin comprising:

an electronic parking meter having:

means for providing power;

means for processing connected to said means for providing power, said means for processing having at least a power-up mode, a standby mode and an operational mode;

means for receiving the coin and generating a coin signal upon receipt thereof;

means for activating said means for processing in response to said coin signal; receipt of said coin signal causing said means for processing to change from said standby mode to said operational mode;

means for identifying the coin as said coin passes said means for identifying and providing an identification signal to said means for processing indicative of the coin;

means for oscillating providing an oscillator output signal having a predetermined frequency, said oscillator output signal frequency divided by means for dividing to supply a clock signal to said means for processing, said means for dividing being deactivated by said means for activating when said means for processing is in said standby mode and activated by said means for activating when said means for processing is in said operational mode;

means for displaying information connected to said means for processing;

means for interfacing connected to said means for processing; and an auditor having a means for interfacing with said means for interfacing in said electronic parking meter thereby effecting a supplying of information to said electronic parking meter and a receiving of data from said electronic parking meter.

2. An electronic parking meter system according to claim 1, wherein said means for providing power comprises:

at least one solar cell for producing a predetermined cell voltage;

at least one capacitor for being charged by said cell voltage to a predetermined capacitor voltage; and means for regulating said cell voltage and said capacitor voltage and outputting a predetermined regulated voltage.

3. An electronic parking meter system according to claim 2, wherein said means for supplying power further comprises a pair of terminals connected across said capacitor for supplying an external voltage from said auditor to charge said capacitor.

4. An electronic parking meter system according to claim 3, wherein said external voltage is also received by said means for regulating.

5. An electronic parking meter system according to claim 2, wherein said means for regulating comprises at least first and second voltage regulators wherein said first regulator operates continuously and is connected to said means for processing and said second regulator is turned off during said standby mode and is connected to at least said means for identifying the coin.

6. An electronic parking meter system according to claim 1, wherein said means for providing power comprises:

at least first and second solar cell arrays connected in parallel for producing a predetermined cell voltage, each having a positive and negative terminal;

at least first and second plurality of series-connected capacitors connected between said positive and negative terminals of said first and second solar cell arrays, respectively, for being charged by said cell voltage to a predetermined capacitor voltage;

means for regulating said cell voltage and said capacitor voltage and outputting a predetermined regulated voltage.

7. An electronic parking meter system according to claim 6, wherein said means for providing power further comprises a pair of terminals connected across said first and second plurality of series-connected capacitors for supplying an external voltage from said auditor to charge said first and second plurality of capacitors, said external voltage also being received by said means for regulating.

8. An electronic parking meter system according to claim 1, wherein said means for processing comprises:

microprocessor having a memory connected thereto; interrupt logic circuit connected to said means for activating and to said microprocessor; and means for timing connecting to said interrupt logic circuit and to said microprocessor.

9. An electronic parking meter system according to claim 8, wherein said means for timing comprises a time base generator connected to a fixed oscillator having a predetermined frequency.

10. An electronic parking meter system according to claim 9, wherein said fixed oscillator operates continuously while said microprocessor is in said standby mode.

11. An electronic parking meter system according to claim 1, wherein said means for identifying the coin is at least a Hall-effect ferrous metal detector.

12. An electronic parking meter system according to claim l, wherein said means for identifying the coin is at least an infrared LED and large area photodiode system for detecting the diameter of the coin.

13. An electronic parking meter system according to claim 1, wherein said means for identifying the coin is at least a frequency shift metallic detector.

14. An electronic parking meter system according to claim 1, wherein said means for processing energizes said means for identifying a plurality of times to obtain of plurality of identification signals as said coin passes said means for identifying.

15. An electronic parking meter system according to claim 1, wherein said means for identifying the coin is the combination of a ferrous metal detector, a diameter detector and a metallic detector which the coin passes in a continuous movement without substantially contacting said detectors.

16. An electronic parking meter system according to claim 1, wherein said system further comprises means for resetting connected to at least said means for processing for placing said means for processing in a power-up mode, when said means for providing power first applies power to said means for processing.

17. An electronic parking meter system according to claim 1, wherein said means for processing outputs a data signal and a clock signal; and wherein said means for displaying information comprises:

a data input for receiving said data signal and a clock input for receiving said clock signal;

shift register connected to said data input;

internal oscillator connected to an oscillator output of said shift register, said shift register also having a plurality of selected outputs;

divide counter connected to a control output of said shift register and to said oscillator;

means for controlling display elements and connected to said shift register, said internal oscillator and said device counter and having a plurality of display outputs connected to said display elements wherein a selected display element can be put in a flashing mode by said means for processing afterwhich said means for processing can be placed in a standby mode.

18. An electronic parking meter system according to claim 1, wherein said means for interfacing on said electronic parking meter and on said auditor comprises an infrared transmission system wherein each of said meter and auditor has an infrared transmitter and receiver.

19. An electronic parking meter system according to claim 1, wherein said means for interfacing on said electronic parking meter and on said auditor comprises means for receiving an electrical cable and an electrical cable for connecting said auditor to said meter.

20. An electronic parking meter for accepting at least one type of coin comprising:

power supply microprocessor having a memory and connected to said power supply, said microprocessor having at least a power-up mode, a standby mode and an operational mode;

coin signal generator for producing a coin signal upon receipt of a coin by the meter;

interrupt logic circuit for placing said microprocessor in said operational mode from said standby mode upon receiving said coin signal;

oscillator connected to said interrupt logic circuit and, said oscillator providing an oscillator output signal having a predetermined frequency, said oscillator output signal frequency divided by means for dividing to supply a clock signal to said microprocessor, said means for dividing being deactivated by said logic circuit when said microprocessor is in said standby mode and activated by said logic circuit when said microprocessor is in said operational mode;

at least one coin detector providing an identification signal to said microprocessor, the coin passing said detector without substantially stopping or contacting said detector; and electronic display connected to said microprocessor.

21. An electronic parking meter according to claim 20, wherein said meter further comprises reset logic circuit connected at least to said microprocessor for placing said microprocessor in said power-up mode.

22. An electronic parking meter system according to claim 20, wherein said meter further comprises means for interfacing with an auditor connected to said microprocessor for receiving information from the auditor and sending data to the auditor.

23. An electronic parking meter system according to claim 20, wherein said meter further comprises sonar range finder system for detecting the presence or absence of a vehicle in an associated parking space, said sonar range finder system connected at least to said microprocessor.

24. An electronic parking meter system according to claim 20, wherein said power supply comprises at least one solar cell array producing a cell voltage; at least one capacitor connected to said solar cell array for being charged by said cell voltage to a capacitor voltage; and at least one regulator receiving at least said capacitor voltage and outputting a predetermined regulated voltage.

25. An electronic parking meter system according to claim 20, wherein said power supply comprises at least first and second solar cell arrays connected in parallel for producing a predetermined cell voltage; each having a positive and negative terminal; at least first and second plurality of series connected capacitors connected between said positive and negative terminals of said first and second solar cell arrays, respectively, for being charged by said cell voltage to a predetermined capacitor voltage; first and second regulators receiving said cell voltage and said capacitor voltage, said first regulator outputting a first predetermined regulated voltage continuously to said microprocessor and said second regulator outputting a second predetermined regulated voltage to at least said coin detector when said microprocessor is in an operational mode.

26. An electronic parking meter system according to claim 20, wherein said oscillator operates continuously when said microprocessor is in said standby mode and in said operational mode.

27. An electronic parking meter system according to claim 20, wherein said coin detector is a Hall-effect ferrous metal detector, and wherein said microprocessor energizes said detector a plurality of times to obtain a plurality of identification signals as said coin passes said detector.

28. An electronic parking meter system according to claim 20, wherein said coin detector is an infrared LED and large area photodiode system for detecting the diameter of the coin, and wherein said microprocessor energizes said detector a plurality of times to obtain a plurality of identification signals as said coin passes said detector.

29. An electronic parking meter system according to claim 20, wherein said coin detector is a frequency shift metallic detector, and wherein said microprocessor energizes said detector a plurality of times to obtain a plurality of identification signals as said coin passes said detector.

30. An electronic parking meter system according to claim 20, wherein said electronic display has an internal oscillator which flashes a selected display element in said electronic display when said microprocessor is in said standby mode, said microprocessor providing a signal to said display to cause said internal oscillator to be connected to said selected element when said microprocessor is in said operational mode.

31. An electronic parking meter for receiving at least one type of payment element comprising;

means for providing power;

means for processing connecting to said means for providing power, said means for processing having at least a power-up mode, a standby mode and an operational mode;

means for receiving the payment element and generating a payment signal upon receipt thereof;

means for activating said means for processing in response to said payment signal, receipt of said payment signal causing said means for processing change from said standby mode to said operational mode;

means for identifying the payment element and providing an identification signal to said means for processing indicative of the payment element;

means for oscillating providing an oscillator output signal having a predetermined frequency, said oscillator output signal frequency divided by means for dividing to supply a clock signal to said means for processing, said means for dividing being deactivated by said means for activating when said means for processing is in said standby mode and activated by said means for activating when said means for processing is in said operational mode;

means for displaying information connected to said means for processing.

32. An electronic parking meter system according to claim 31, wherein said means for providing power comprises:

at least first and second solar cell arrays connected in parallel for producing a predetermined cell voltage, each having a positive and negative terminal;

at least first and second plurality of series-connected capacitors connected between said positive and negative terminals of said first and second solar cell arrays, respectively, for being charged by said cell voltage to a predetermined capacitor voltage;

means for regulating said cell voltage and said capacitor voltage and outputting a predetermined regulated voltage.

33. An electronic parking meter system according to claim 31, wherein said means for processing comprises:

microprocessor having a memory connected thereto;

interrupt logic circuit connected to said means for activating and to said microprocessor; and means for timing connecting to said interrupt logic circuit and to said microprocessor.

34. An electronic parking meter system according to claim 33, wherein said means for timing comprises a time base generator connected to a fixed oscillator having a predetermined frequency.

35. An electronic parking meter system according to claim 34, wherein said fixed oscillator operates continuously while said microprocessor is in said standby mode.

36. An electronic parking meter system according to claim 31, wherein said means for processing outputs a data signal and a clock signal; and wherein said means for displaying information comprises:

a data input for receiving said data signal and a clock input for receiving said clock signal;

shift register connected to said data input;

internal oscillator connected to an oscillator output of said shift register, said shift register also having a plurality of selected outputs;

divide counter connected to a control output of said shift register and to said oscillator;

means for controlling display elements and connected to said shift register, said internal oscillator and said device counter and having a plurality of display outputs connected to said display elements wherein a selected display element can be put in a flashing mode by said means for processing afterwhich said means for processing can be placed in a standby mode.

37. An electronic parking meter according to claim 31, wherein said means for providing power comprises:

at least one solar cell for producing a predetermined cell voltage;

at least one capacitor for being charged by said cell voltage to a predetermined capacitor voltage; and means for regulating said cell voltage and said capacitor voltage and outputting a predetermined regulated voltage.

38. An electronic parking meter according to claim 37, wherein said means for providing power further comprises a pair of terminals connected across said capacitor for receiving an external voltage to charge said capacitor.

39. An electronic parking meter according to claim 38, wherein said external voltage is also received by said means for regulating.

40. An electronic parking meter according to claim 37, wherein said means for regulating comprises at least first and second voltage regulators wherein said first regulator operates continuously and is connected to said means for processing and said second regulator is turned off during said standby mode and is connected to at least said means for identifying.

41. An electronic parking meter according to claim 32, wherein said means for providing power further comprises a pair of terminals connected across said first and second plurality of series-connected capacitors for supplying an external voltage to charge said first and second plurality of capacitors, said external voltage also being received by said means for regulating.

42. An electronic parking meter according to claim 31, wherein said payment element is a coin and said means for identifying the coin is a Hall-effect ferrous metal detector.

43. An electronic parking meter according to claim 31, wherein said payment element is a coin and wherein said means for identifying the coin is an infrared LED and large area photodiode system for detecting the diameter of the coin.

44. An electronic parking meter according to claim 31, wherein said payment element is a coin and wherein said means for identifying the coin is a frequency shift metallic detector.

45. An electronic parking meter according to claim 31, wherein said means for processing energizes said means for identifying a plurality of times to obtain a plurality of identification signals.

46. An electronic parking meter according to claim 31, wherein said payment element is a coin and wherein said means for identifying the coin is the combination of a ferrous metal detector, a diameter detector and a metallic detector which the coin passes in a continuous movement without substantially contacting said detectors.

47. An electronic parking meter according to claim 31, wherein said system further comprises means for resetting connected to at least said means for processing for placing said means for processing in a power-up mode, when said means for providing power first applies power to said means for processing.

48. An electronic parking meter according to claim 31, wherein said electronic parking meter further comprises:

means for interfacing connected to said means for processing; and an auditor having a means for interfacing with said means for interfacing in said electronic parking meter thereby effecting a supplying of information to said electronic parking meter and receiving of data from said electronic parking meter.

49. An electronic parking meter according to claim 48, wherein said means for interfacing on said electronic parking meter and on said auditor comprises an infrared transmission system wherein each of said meter and auditor has an infrared transmitter and receiver.

50. An electronic parking meter according to claim 48, wherein said means for interfacing on said electronic parking meter and on said auditor comprises means for receiving an electrical cable and an electrical cable for connecting said auditor to said meter.

51. A method of operating an electronic parking meter for receiving at least one type of payment element comprising the steps of:

providing power;

connecting a means for processing to said power, said means for processing having at least a power-up mode, a standby mode and an operational mode;

receiving the payment element and generating a payment signal upon receipt thereof;

activating said means for processing in response to said payment signal, a receipt of said payment signal causing said means for processing to change from said standby mode to said operational mode;

identifying the payment element and providing an identification signal to said means for processing indicative of the payment element;

providing a means for oscillating having an oscillator output signal having a predetermined frequency, frequency dividing said oscillator output signal by a means for dividing, supplying a clock signal from said means for dividing to said means for processing, deactivating said means for dividing when said means for processing is in said standby mode and activating said means for dividing when said means for processing is in said operation mode; and displaying information from said means for processing.

52. The method of operating an electronic parking meter according to claim 51, wherein said method further comprises:

intermittently placing said means for processing in said operational mode from said standby mode;

connecting said means for oscillating to a means for timing;

operating said means for timing;

displaying at least timing information from said means for timing, when said means for processing is intermittently in said operational mode.

53. The method of operating an electronic parking meter according to claim 52, wherein said method further comprises:

sonar detecting the presence of a vehicle parked in a space associated with said meter; and returning said means for timing to zero when the presence of a vehicle is not detected.

54. The method of operating an electronic parking meter according to claim 51, wherein said method further comprises:

instructing a display to continuously flash a selected element; and placing said means for processing in a standby mode.

55. The method of operating an electronic parking meter according to claim 51, wherein said method further comprises:

programming said means for processing by:

placing said means for processing in a programming mode;

inserting at least one payment element in said meter a plurality of times;

determining the type of payment element received by analyzing in said means for processing signals received from payment element detectors in said electronic parking meter.

* * * * *